US006179683B1

(12) United States Patent
Pell et al.

(10) Patent No.: US 6,179,683 B1
(45) Date of Patent: Jan. 30, 2001

(54) SWIMMING AQUATIC CREATURE SIMULATOR

(75) Inventors: Charles A. Pell; Stephen A. Wainwright, both of Durham, NC (US)

(73) Assignee: Nekton Technologies, Inc., Durham, NC (US)

( * ) Notice: Under 35 U.S.C. 154(b), the term of this patent shall be extended for 0 days.

(21) Appl. No.: 08/388,741

(22) Filed: Feb. 15, 1995

Related U.S. Application Data

(63) Continuation-in-part of application No. 08/016,167, filed on Feb. 10, 1993, now abandoned.

(51) Int. Cl.[7] ..... A63H 23/04
(52) U.S. Cl. ..... 446/154; 446/153; 440/15
(58) Field of Search ..... 490/13, 14, 15; 496/153, 156, 158, 154; 93/42.24

(56) References Cited

U.S. PATENT DOCUMENTS

| | | | | |
|---|---|---|---|---|
| 1,661,758 | | 3/1928 | King | 446/158 |
| 2,854,787 | * | 10/1958 | Oberg | 440/15 X |
| 2,936,729 | | 5/1960 | Kuttner | 440/15 X |
| 3,110,283 | | 11/1963 | Warner | 440/15 X |
| 3,165,086 | | 1/1965 | Eastep | 416/81 |
| 3,218,750 | | 11/1965 | Lewin | 446/159 X |
| 3,239,956 | | 3/1966 | Canonica, Jr. | 40/106.45 |
| 3,382,606 | | 5/1968 | Johnson . | |
| 3,783,552 | | 1/1974 | Goldbach | 446/158 |
| 3,785,084 | | 1/1974 | Aenishanslin . | |
| 3,874,320 | * | 4/1975 | Wood | 440/15 |
| 4,172,427 | * | 10/1979 | Kindred | 440/15 |
| 4,448,409 | | 5/1984 | Kaga et al. | 272/8 N |
| 4,536,985 | | 8/1985 | Caviness | 47/17.6 |
| 4,578,044 | | 3/1986 | Saitoh | 446/134 |
| 4,674,223 | | 6/1987 | Peqarce | 43/26.2 |
| 4,713,037 | | 12/1987 | Tong | 446/158 |
| 4,832,650 | | 5/1989 | Tong | 446/156 |

FOREIGN PATENT DOCUMENTS

| | | | | |
|---|---|---|---|---|
| 27 14 517 | | 10/1978 | (DE) | 416/82 |
| 522934 | * | 8/1921 | (FR) | 440/15 |
| 582928 | | 12/1946 | (GB) | 446/154 |
| 2243088 | | 10/1991 | (GB) . | |

OTHER PUBLICATIONS

Blight, Andrew Undulatory Swimming with and Without Waves of Contraction, *Nature* 264 (Nov. 25, 1976).
Blight, Andrew Muscular Control of Vertebrate Swimming Movements, *Biol. Rev.* 52:181–218 (1977).
Sir James Gray, *Animal Locomotion* pp. 18–43 (1968) (Great Britian).
Breder, Charles *The Locomotion of Fishes* pp. 159–191, 291–293 (1926) (US).

* cited by examiner

*Primary Examiner*—Sam Rimell
(74) *Attorney, Agent, or Firm*—Myers Bigel Sibley & Sajovec

(57) ABSTRACT

A swimming aquatic creature simulator having a body which propagates waves of undulation of and along that body to thereby propel the simulator through a fluid in a lifelike manner. The body is formed of an elastomeric material and may be shaped like a fish. Applying oscillating rotational motion to the body at a location forward of the center of mass of the body produces undulating movements of the body which propel the simulator. The oscillating motion input may be provided by twisting a rigid shaft or flexible cable, which is connected to the body at a point forward of the center of mass. An internal motor can also be used to provide the oscillating motion input.

18 Claims, 5 Drawing Sheets

SWIMMING AQUATIC CREATURE SIMULATOR

RELATED APPLICATIONS

This application is a continuation-in-part of co-pending application Ser. No. 08/016,167, filed Feb. 10, 1993, now abandoned, the disclosure of which is incorporated by reference herein in its entirety.

FIELD OF THE INVENTION

This invention relates to swimming aquatic creature simulators, and, in particular, to swimming fish simulators that propel themselves through fluid in a lifelike manner.

BACKGROUND OF THE INVENTION

A variety of inexpensive mechanical toy aquatic creatures, such as fish and sharks, can be found in typical toy stores. The selling point of many of these toys arises from their ability to propel themselves through a fluid medium such as water. Small motors positioned within the creatures are operatively connected to mechanisms which oscillate their respective tails to make the creatures swim. However, despite the best efforts of toy manufacturers, these creatures swim in a manner which will almost assuredly not be confused with actual fish. The mechanical construction of the toys produces an equally mechanical swimming operation, a motion not found in smoothly flexible living fish. Moreover, the need for a battery power source, as well as the multiple piece drive mechanism, results in high manufacturing and assembly costs.

Several representative mechanical constructions are well known in the art. For instance, in providing propelling means, some toy designs utilize a rigid tail fin which simply pivots relative to the fish body in constant back and forth manner. This type of motion is most similar to ostraciiform motion exhibited by some species of fish. While the pivoting of the rigid tail fin does serve to propel the toy, it appears substantially different from the tail motion normally attributed to typical swimming fish, and therefore appears non-lifelike. Other designs, as disclosed in U.S. Pat. Nos. 3,785,084, 4,713,037 and 4,832,650 strive to better imitate the curvy fish tail movement associated with carangiform motion. This motion, which is more familiar to the public as it is a motion characteristic of fish such as salmon or trout, is attempted to be imitated by employing an articulated, two-piece tail section made up of rigid segments. The forward piece of the tail section is mechanically oscillated, while the rearward piece of the tail section is freely pivotable thereon. Nonetheless, despite being more recognizable as a fishlike swimming motion than a pivoting one-piece tail design, the two-piece tail design still falls woefully short of properly imitating the smooth swimming motions of a live fish.

Another shortcoming of aquatic creature toys relates to the limited span of time in which users, normally children, find them interesting. While almost all toys eventually lose their novelty, the fact that the current aquatic toys do not require hands-on participation accelerates the process. The excitement of play first provided by these toys gradually turns to boredom because users perform such a passive role. After activating these toys and placing them in, for instance, a bathtub, the only thing left for a user to do is idly watch.

Focused efforts to develop devices which imitate the swimming motion of fish in a lifelike manner are not limited to the toy manufacturing industry. The scientific community has long been interested in understanding how fish swim, as evidenced by Breeder, Charles M. Jr., "*The Locomotion of Fishes" Zoologica,* Vol. IV, No. 5 (1926), which is herein incorporated by reference. Members of the scientific community, in their efforts to achieve a better understanding of fish motion, have also created devices used to explain or recreate the swimming motion of fish. For instance, scientific devices or models with various mechanical attachments which attempt to imitate the swimming undulating motion of fish are disclosed in *Animal Locomotion* by Sir James Gray, published in 1968 by Weidenfeld and Nicolson, and *Fish Biomechanics* edited by Paul Webb and Daniel Weihs, published in 1983 by Praeger, which are herein incorporated by reference.

The motivation of the scientific community for developing a swimming fish simulator are many in number. For example, providing a simulator which a researcher can precisely operate and command allows a more exact control to be utilized in fish studies or research; where tail beat frequency and amplitude can be continuously and precisely controlled by the operator the relationships among these parameters and the speed of swimming can be analyzed. Another important reason for developing simulators is to gain a better understanding of the propulsion mechanics of various types of aquatic creatures. Different species of fish have different body shapes and amounts of fast (white) and slow but long-enduring (red) muscle. Some are sprinters, some are cruisers, and some are highly maneuverable. By varying shape parameters and the pattern of actuation of simulators, scientists can learn which combinations of shape, stiffness, and actuation patterns provide the highest locomoter performance of fishes and other aquatic animals. Engineers can use this information to design driven and autonomous underwater vehicles of increased efficiency. By learning about fish and putting gained knowledge into practice in simulators, scientists can begin tapping the energy efficiencies in the swimming motion of fish which nature has perfected over several hundred million years.

OBJECTS OF THE INVENTION

Accordingly, one object of the invention is to provide a swimming creature simulator which propels itself through a fluid in a lifelike manner.

Another object of the invention is to provide a swimming creature simulator which is inexpensive to manufacture due to its fabrication from readily available materials and uncomplicated construction.

A still further object of the invention is to provide a swimming creature simulator which can be utilized in scientific research of marine and aquatic life due to the lifelike swimming motion of the simulator.

A still further object of the invention is to provide a device which employs the propulsion mechanics of fishlike motion to transport otherwise static fluid (i.e., generate thrust in the fluid).

SUMMARY OF THE INVENTION

The present invention pertains to a swimming creature simulator having an elongate elastomeric body approximately as dense as water, the elongate body having a forward portion forward of the center of mass of the body and a tail portion rearward of the center of mass. The tail portion is tapered in a frontal plane of the body so that the tail portion has a greater cross-sectional thickness toward the center of mass than at the rear tip of the body. Means for imparting oscillating rotational motion is provided at a point forward of the center of mass of the body. The rotational motion occurs about an axis which is perpendicular to a frontal plane of the body and in the median plane of the body. When the swimming creature simulator is placed in water, input of oscillating rotational motion causes rearward traveling undulating movements in the body which propel the simulator through the water. The present invention further pertains to methods of propelling a swimming creature simulator through a fluid.

The present invention, in another form thereof, pertains to a device for transducing oscillating rotary movement into rearwardly propagating waves of undulation. The device comprises an elongate body of elastomeric material having a forward portion forward of the center of mass of the body and a rearward portion rearward of the center of mass. The rearward portion is tapered rearwardly in a frontal plane of the body so as to have a greater cross-sectional thickness toward the center of mass than at the rear of the body. Means for imparting oscillating rotational motion to a point forward of the center of mass is provided. Rotational motion occurs about an axis which is perpendicular to the frontal plane and in the median plane of the body. When the elongate body is placed in a body of fluid, the input of oscillating rotational motion causes rearwardly propagating waves of undulation in the elongate body. When the device is fixed in position with respect to a base and inserted in a body of fluid, the undulating movements transport fluid from the forward portion of the body toward the rearward portion.

DETAILED DESCRIPTION

The present inventors' study of the biomechanics of fish propulsion led to the unexpected finding that an appropriately shaped body having certain elastic properties, when placed in a fluid of appropriate density and viscosity and subjected to the input of oscillating rotational motion, reproduces the swimming motions of living anguilliform or carangiform fish and propels itself forward through the water.

In its broadest sense, the present invention relates to an appropriately-shaped elastic body, immersed in a fluid, that transduces a mechanical input of oscillating motion into rearwardly propagating waves of undulation of and along that elastic body for the purpose of creating forward thrust in fluid immediately surrounding the elastic body. One application of the present invention is to provide an aquatic creature simulator which propels itself through the fluid in a smooth lifelike manner.

Figure 8:
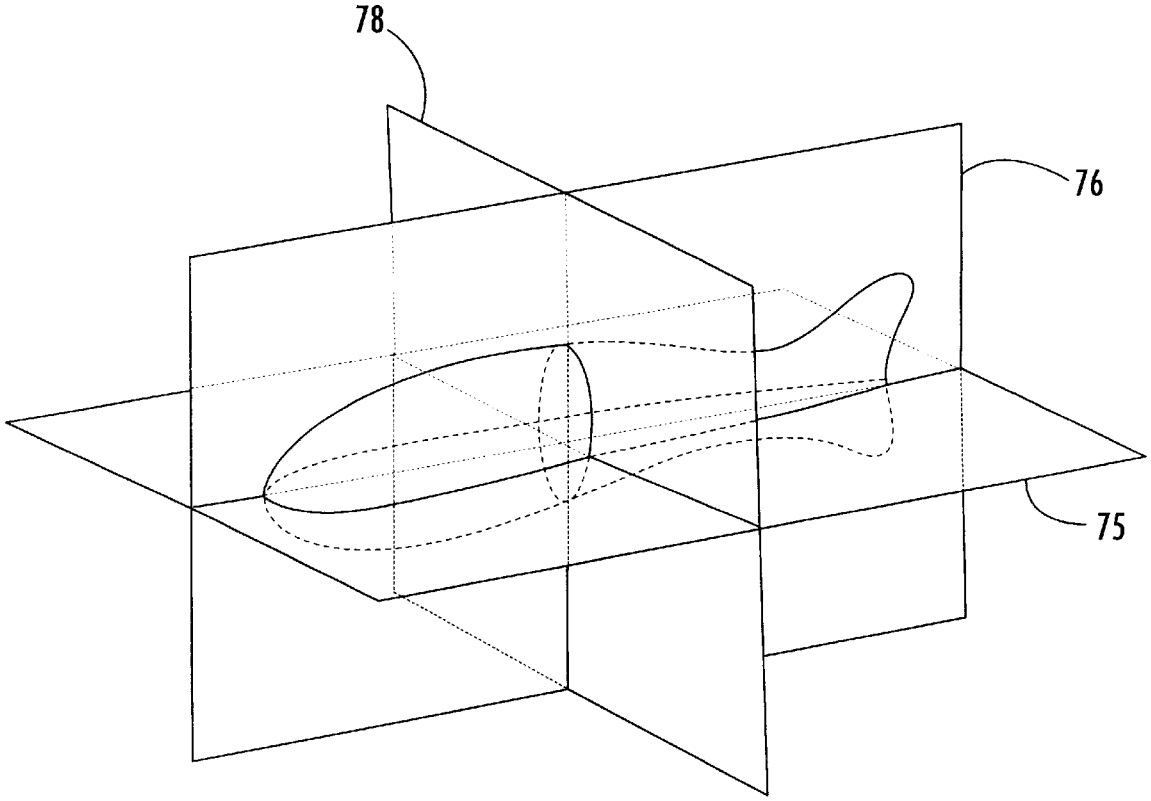
FIG. 8 is a schematic drawing showing the planes of orientation of an aquatic creature simulator according to the present invention.

In describing swimming creature simulators according to the present invention, reference will be made to the following planes of orientation. As shown in FIG. 8 and as used herein, median plane 76 divides the elongate body of the swimming creature simulator vertically and lengthwise, dividing the body into right and left portions. Frontal plane 75 is a longitudinal plane transverse to the elongate body, dividing the body into dorsal and ventral portions. Coronal plane 78 is a vertical plane at right angles to a median plane, and divides the body into anterior and posterior portions.

The present inventors have developed a swimming creature simulator which propels itself through fluid in response to the input of oscillating rotational motion. In a simulator according to the present invention, when the simulator is immersed in fluid of the appropriate kinematic viscosity, oscillating rotational motion is transduced into rearwardly propagating waves of undulation in the elongate elastomeric body of the device, providing a net forward propulsive effect. Kinematic viscosity, as defined in the art, is the ratio of the dynamic viscosity to the density of the fluid. The elongate body of the present device has a forward tip, a forward portion forward of the center of mass of the elongate body, a rearward portion rearward of the center of mass of the elongate body, and a rear tip. The rearward portion of the elongate body tapers, that is, the thickness (i.e., width) in the frontal plane decreases rearwardly along a line from the center of mass to the rear tip.

In use, in response to the input of oscillating rotational motion at a point forward of the center of mass, waves of undulation pass rearwardly along the elongate elastomeric body of the present invention. In a simulator such as that shown in FIGS. 3–7, at least one complete wavelength is seen in the body during use. These waves are the result of the interactions between the oscillating motion input, the elastomeric body, and the kinematic viscosity of the fluid in which the device operates. The net result of the vector forces produced by the rearwardly propagating undulating waves of the elastomeric body in the fluid propels the device forward, that is, in a direction essentially perpendicular to the axis of rotation of the oscillating rotational motion, and opposite that of the full wave propagation. The direction of travel relative to the fluid environment in which the body is placed may be altered by angling the axis of rotation. The forward motion of the elastomeric body is produced solely by the input of oscillating rotational motion; the device is neither pushed nor pulled by the user through the fluid in the direction of travel. The oscillating rotational motion may also be described as a yawing motion. The present device can accurately reproduce the smooth propulsive whole-body movements of a swimming fish without reproducing the intricate structure of the complex muscle, tendon and skeletal systems found in living fish and without any mechanical joints or pivots.

The elongate body of a device according to the present invention has a front tip, a front portion in front of the center of mass, a rearward portion behind the center of mass, and a rear tip. (As used herein, "tip" does not refer to any particular geometry but is used to define the front and rear edges or surfaces.) The rearward portion of the elongate body tapers in the frontal plane, that is, the average width or thickness of the body in the frontal plane decreases from the center of mass to the rear tip. The axis of rotational motion lies in the median plane of the elongate body; the median plane is perpendicular to the frontal plane. The rearwardly propagating waves of undulations which occur in the elongate body in response to input of oscillating rotational motion occur in the frontal plane.

Optionally, as is apparent from FIGS. 3–7, the height of the elongate body may vary along its length. A preferred general shape of a simulator according to the present invention is generally rounded at the forward tip, tapering in height (i.e., in the median plane) toward the front tip and the rear tip, and broadest (in the frontal plane) and tallest (in the median plane) at a point in the middle section of the body. Appropriate shaping of the tapering rearward portion provides a rear tail fin lying in the median plane; the tail fin is thin in the body's plane of undulation and taper (the frontal plane) and provides a fish-like appearance to the device. It will be apparent to those skilled in the art that a 90° rotation of the fish-like body described above provides a whale-like body having tail flukes, and the present invention includes such whale-like embodiments. Optionally, small irregularities in the surface of the body, or small appendages attached to the surface of the body which do not grossly affect the motion of the simulator, may mimic additional features of a living fish including but not limited to scales, opercula, and fins.

The length of the elastomeric body of a device according to the present invention is from about 1 centimeter to about 5 meters. As noted above, the rearward portion of the body tapers in width; the degree of taper is between about 0.5 degrees to about 45 degrees. More preferably, the degree of taper is from about 0.5 to 10 degrees up to about 30 or 35 degrees. The ratio of the average cross-sectional diameter of the body to total body length is between about 1:1 to about 1:50 (average diameter:total body length), and is more preferably from about 1:4 to about 1:27. The ratio of the average cross-sectional height of the body to the average cross-sectional width is from about 150:1 to about 1:1 (average height:average width), and is more preferably from about 37:1 to about 1.5:1. As used herein, cross-sectional measurements are made in the coronal plane.

The total density of the elongate elastomeric body of a device according to the present invention is between about 0.5 to about 2.5 times the density of the fluid in which it operates. More preferably, the elongate elastomeric body possesses a density approximately equal to that of the fluid environment in which it is used.

The selected material used in the present invention must exhibit characteristics of resilient elastic recoil, which pertains to the ability of the material to efficiently store and release the potential energy of gross strain deformations to which it is subjected. Suitable materials possess a resiliency of between about 30% to about 98%, and more preferably possess a resiliency of between about 50% and about 98%. Further, suitable materials possess a Young's modulus of elasticity within the range of from about $1.5\times10^{-2}$ to about $2.9\times10^{6}$ megapascals (Newtons per square meter). More preferably, the Young's modulus of elasticity is from about 0.1 to about 100 megapascals.

The density, Young's modulus, and the elastic recoil necessary to make the simulators of the present invention operate properly, i.e. yield thrust producing rearwardly propagating waves of undulation, depend on the kinematic viscosity of the fluid in which the simulators operate. This relationship stems from the fact that when the elastic body of the simulator is subjected to oscillating rotation motion while immersed in the appropriate fluid, the natural tendency of the elastic body to swing freely and widely side to side is damped and delayed by the effects of that fluid. Rearwardly propagating undulations develop as damping transfers momentum from the body to the surrounding fluid, producing thrust. Appropriate fluids in which a device according to the present invention may be operated include gas or liquid such as air or water; the kinematic viscosity of the fluid must be between about $0.4\times10^{-6}$ $m^2s^{-1}$ to about $16.8\times10^{-6}$ $m^2s^{-1}$. The devices of the present invention operate within fluids at Reynolds numbers of from about $1.5\times10^{2}$ to about $4.5\times10^{7}$, and more preferably from about $1.0\times10^{3}$ to about $3.0\times10^{7}$. The particular shape of the simulator which functions best in a fluid of particular viscosity and density may be determined by trial and error.

Figure 1:
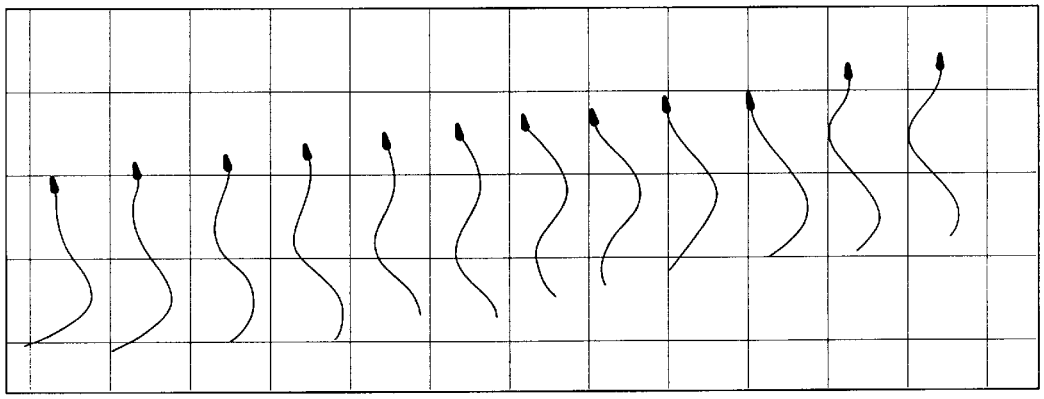
FIG. 1 shows, in a sequenced series of illustrations derived from ciné-films, the undulating movements of the body of a living fish which exhibits anguilliform motion.
Figure 2:
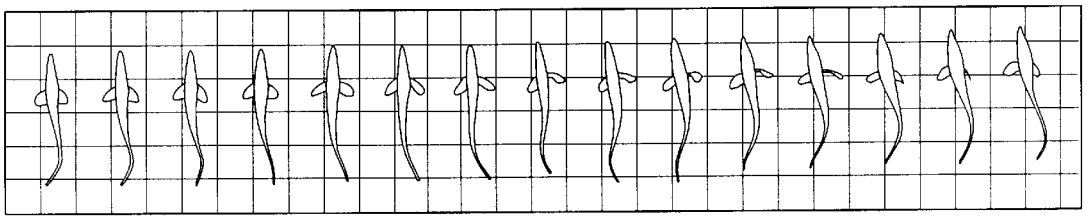
FIG. 2 shows, in a sequenced series of illustrations derived from ciné-films, the undulating movements of the body of a living fish which exhibits carangiform motion.

When oscillating rotational motion is input into simulators of the present invention, the rearwardly propagating waves of motion make the simulators exhibit different forms of movement depending on the construction of their bodies. Some aquatic creature simulators according to the present invention are shaped like eels and include bodies of suitable length and flexibility so that the device displays anguilliform swimming motion. As shown in FIG. 1 (derived from Gray, 1968), this form of motion propels eels in water and is characterized by whole-body undulations greater than one wavelength propagating rearwardly along the body. Other aquatic creature simulators comprise bodies which yield carangiform motion as shown in FIG. 2 (derived from Gray, 1968). Fish such as trout are representative of this type of motion. For simulators shaped like each fish of FIGS. 1 and 2, oscillating rotary motion applied at a portion of the simulator forward of its center of mass results in lifelike undulations in the simulator. These rearwardly propagating undulations serve to propel the simulator through the fluid in a smooth lifelike manner.

Figure 3:
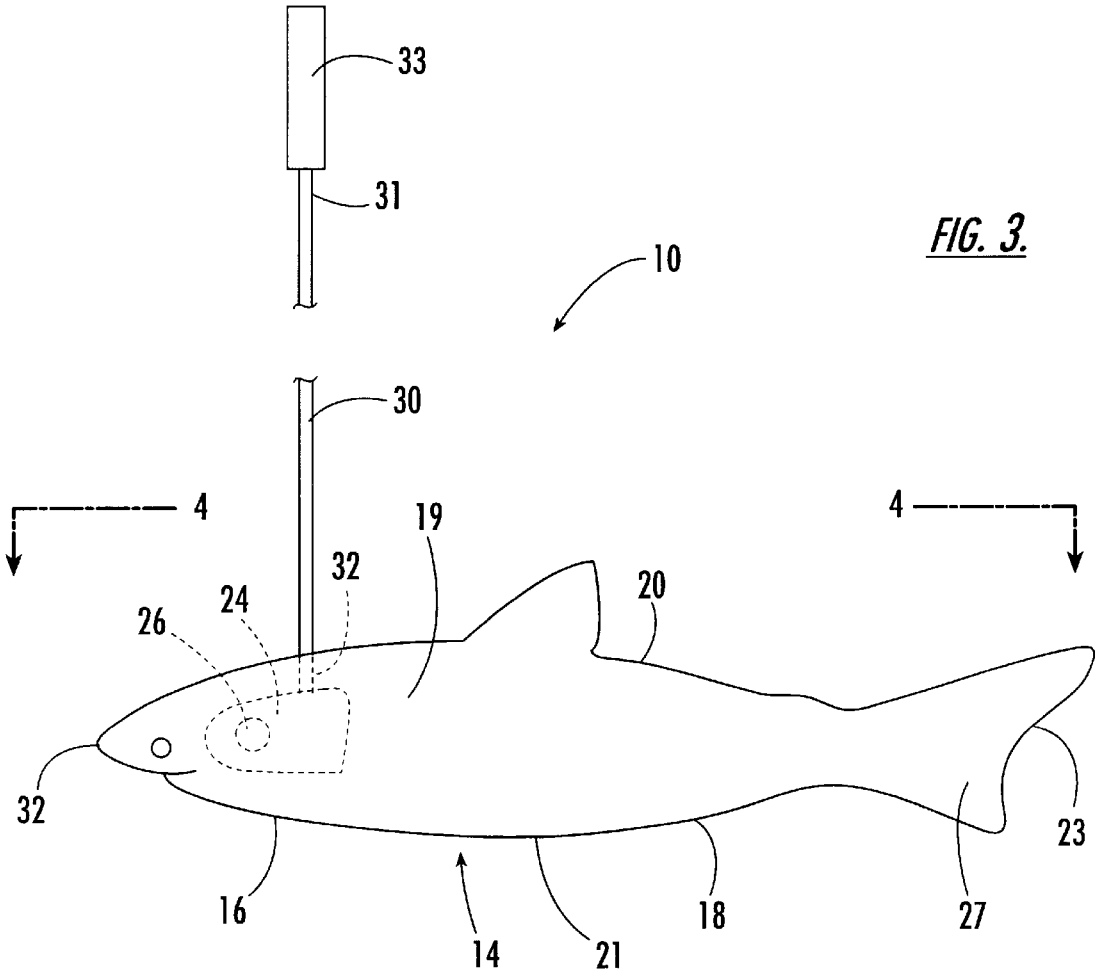
FIG. 3 shows a side view of one embodiment of a swimming aquatic creature simulator according to the present invention wherein the oscillating motion input means is a rigid shaft.

Referring now to FIG. 3, there is shown one embodiment of the swimming aquatic creature simulator of the present invention designed for use in a body of water. A fish simulator, generally designated 10, comprises an elongate body 14 which in overall shape resembles a carangiform fish. This embodiment displays carangiform motion when in operation. While different species of fish can exhibit vastly different body shapes and sizes, fish simulator 10 has a shape readily recognizable by most people as an ordinary fish. However, the body shape selected for illustration purposes is not intended to limit the scope of the invention. As previously stated, the present invention can be adapted to work when shaped like nearly any type of fish as well as other types of aquatic creatures, including eels, whales and dolphins.

Figure 4:
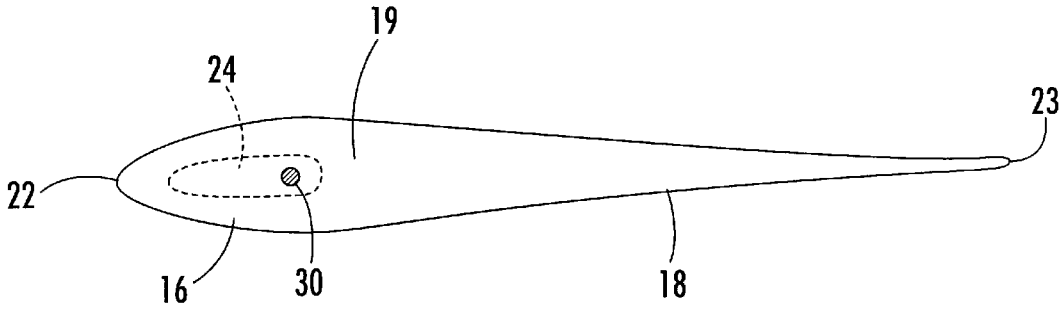
FIG. 4 shows a top view of the swimming aquatic creature simulator of FIG. 3 taken along line 4—4 of FIG. 3.
Figure 5:
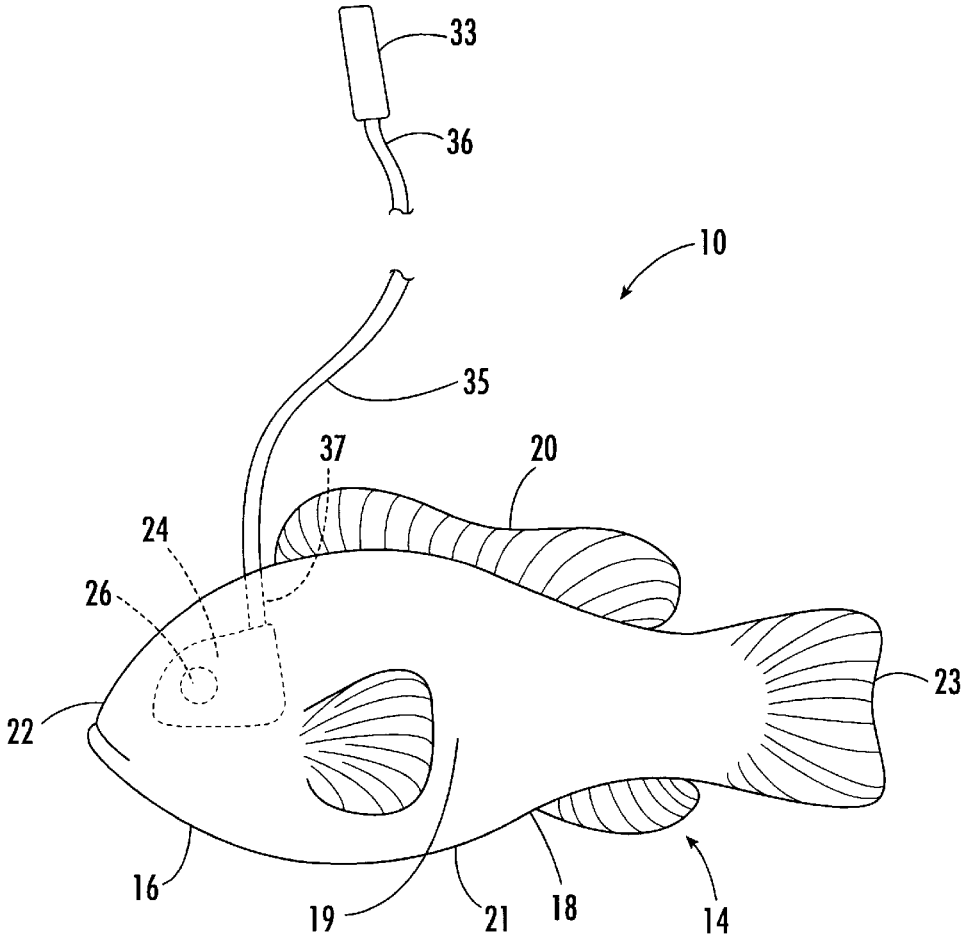
FIG. 5 shows a side view of another embodiment of a swimming aquatic creature simulator according to the present invention wherein the oscillating motion input means is a flexible cable.

With reference to FIGS. 3 and 4, elongate body 14 includes forward portion 16 and rearward tail portion 18 and is further defined by forward tip 22, top 20, bottom 21, and rear tip 23. Along the longitudinal (front to rear) axis of body 14, the junction of forward portion 16 and rearward tail portion 18 occurs at the center of mass 19 of body 14. Rearward tail portion 18, as shown in FIG. 4, tapers rearwardly so as to have a greater cross-sectional thickness toward center of mass 19 than at rear tip 23. Rearward tail portion 18 also varies in height to create tail fin 27.

In one embodiment of the present invention, body 14 is approximately 12 centimeters long, 1 centimeter maximum thickness, and 2.5 centimeters in height, and is fabricated from an elastomeric material which is selected in consideration of the kinematic viscosity of the fluid medium in which fish simulator 10 will be operated. For this embodiment, an elastomeric material having an advantageous and appropriate elastic recoil property for proper function of the invention in water is polyvinyl chloride, supplied by M. F. Manufacturing of Ft. Worth Tex. under the label of Plastic for Making Worms. The proper consistency of this elastomeric material is attained by adding two parts plasticizer for every ten parts vinyl resin hardener.

Embedded within forward portion 16 of body 14 is anchor member 24, which, in one embodiment, is constructed of wood which naturally has porous surfaces. Anchor member 24 also includes eyehole 26 therein which passes entirely through the anchor. The construction of anchor member 24 cooperates with the elastomeric material in a number of ways to prevent the anchor from dislodging and floating freely within body 14. During fabrication of body 14, the elastomeric material of body 14 first penetrates the porous surfaces of anchor member 24 and then cures to mechanically bond therewith.

Eyehole 26 further allows the elastomeric material to penetrate anchor member 24 and topologically restrict anchor member 24 within body 14. Anchor member 24 does not need to be constructed from wood for proper functioning of fish simulator 10. Rather, wood was selected because of its beneficial bonding relationship with the elastomeric material chosen for body 14. When other elastomeric materials are employed, a glass, metal or plastic anchor member having surfaces that chemically bond with these materials would also be an appropriate design. In one embodiment simulator 10 operates in water, and it may be positioned and operated from above (or below) by a user; the combination of anchor member 24 and the elastomeric material selected should produce body 14 which is approximately as dense as water. Of course, in some circumstances a simulator may be equal to or less dense than the fluid in which it operates. For example, an appropriately shaped helium filled body to be used in air would have such a lesser density.

As shown in FIG. 3, rigid shaft 30 vertically extends from fish simulator 10. Bottom end 32 of shaft 30 is secured to anchor member 24 and is positioned in top 20 and forward portion 16 of body 14. As the securing of shaft 30 to anchor member 24 increases the effective radius through which shaft 30 inputs oscillating motion to forward portion 16, the effective shear forces between shaft 30 and body 14 are lesser. Consequently, shaft 30 will less likely twist free from body 14. Top end 31 of shaft 30 includes cylindrical handle 33 which is graspable by a user of fish simulator 10. An alternate embodiment shown in FIG. 5, which is similar to the embodiment of FIG. 3 in all respects except the oscillating motion input means, substitutes flexible cable 35 for shaft 30. Flexible cable 35 is stiff in torsion and includes bottom end 37, which is secured to anchor member 24 and is positioned in top 20 and forward portion 16 of body 14. Top end 36 of cable 35 includes cylindrical handle 33 which is graspable by a user of fish simulator 10. Provided the oscillating motion input means imparts rotary motion at a point on body 14 forward of center of mass 19, simulator 10 will exhibit undulating movements which propel it forward through the water.

Both rigid shaft 30 and flexible cable 35 allow a mechanical input of oscillating rotary motion to body 14. Cylindrical handle 33 is so shaped and sized to be conveniently gripped by a user between her first finger and thumb and rapidly twisted back and forth between the fingers while holding her arm and wrist steady. The preferred oscillating motion consists of rotations of approximately twenty degrees. This input applies a bending moment, which effects oscillating motion, to forward portion 16 of body 14. As a result, rearwardly propagating undulating movements of the body 14 thereby occur to propel simulator 10 through the water in a manner reproducing the movements of a living fish. The axis of rotation of the oscillating input is perpendicular to the frontal plane in which both the undulating movements of the body 14 occur and in which tail portion 18 rearwardly tapers in thickness. At first, some users find that the fish sweeps in wide arcs. Correction of this tendency demands that the oscillating motion input means be twisted faster while reducing the degree of rotation in each twist. After a while, a user finds it easy to mimic the erratic swimming, darting and coasting behaviors of live fish.

In use, devices according to the present invention exhibit a tailbeat frequency (actuation frequency) of between about 0.1 to about 80 hertz. Devices according to the present invention can attain forward motion speeds of up to 10 meters per second. While swimming forward, devices according to the present invention conform to the equation: $1.0\times10^{-2}$ body lengths<tailbeat amplitude<$2.0\times10^{0}$ body lengths, where body length is total body length from front tip to rear tip, and tailbeat amplitude is the total transverse width of the oscillation of the body of the device.

Figure 6:
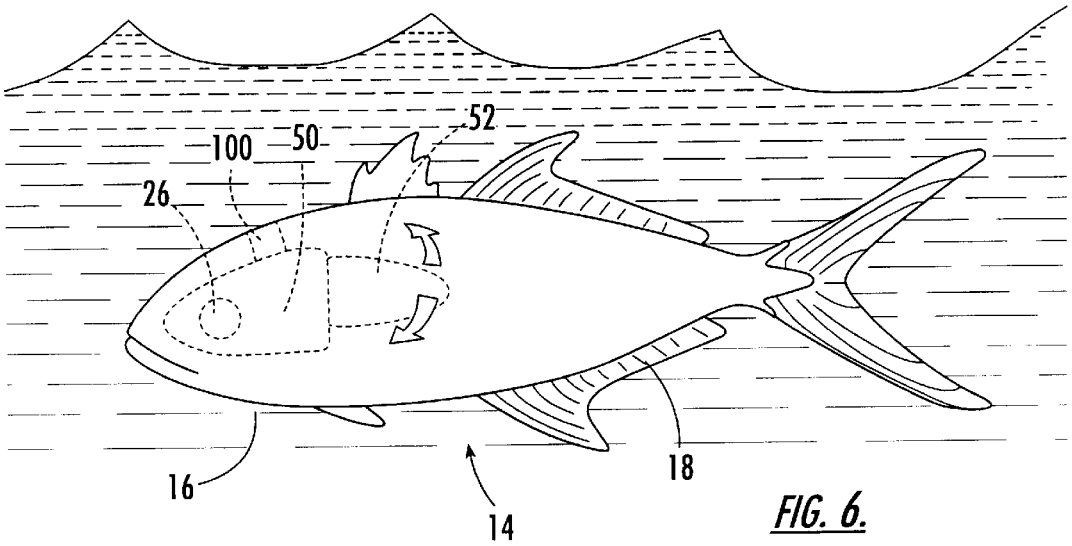
FIG. 6 shows a side view of another embodiment of a swimming aquatic creature simulator according to the present invention wherein an internal motor is the oscillating motion input means.

As shown in FIG. 6, the mechanical input of oscillating motion to body 14 need not be provided from without body 14. An internal motor 50 replaces the one-piece anchor member 24 of the embodiments shown in FIGS. 3–5. Motor 50, which includes displacement preventing eyehole 26, employs a longitudinally extending oscillating shaft 52, pivoting laterally, perpendicular to the median plane. As shown by the directional arrows in FIG. 6, oscillating shaft 52 pivots in the plane of the propagating waves of undulation of body 14 (the frontal plane). In the illustrated embodiment, this plane is parallel to the surface of the water in which it is submerged. Similar to the mechanics of the non-motorized simulators in FIGS. 3 and 5, the resulting oscillating motion input to forward portion 16 of body 14 causes undulating movements of rearward tail portion 18 to thereby propel simulator 10 through the water.

As will be appreciated by those of skill in the art, a wide variety of internal motors such as remote control and windup motors, with a windup key access channel 100, are feasible for use in the invention. In addition to these more conventional motors, other motors are envisioned. For instance, air bags positioned on either side of forward portion 16 which are alternately inflated provide a bending moment to forward portion 16, which leads to undulating, propelling motion of rearward tail portion 18.

Figure 7:
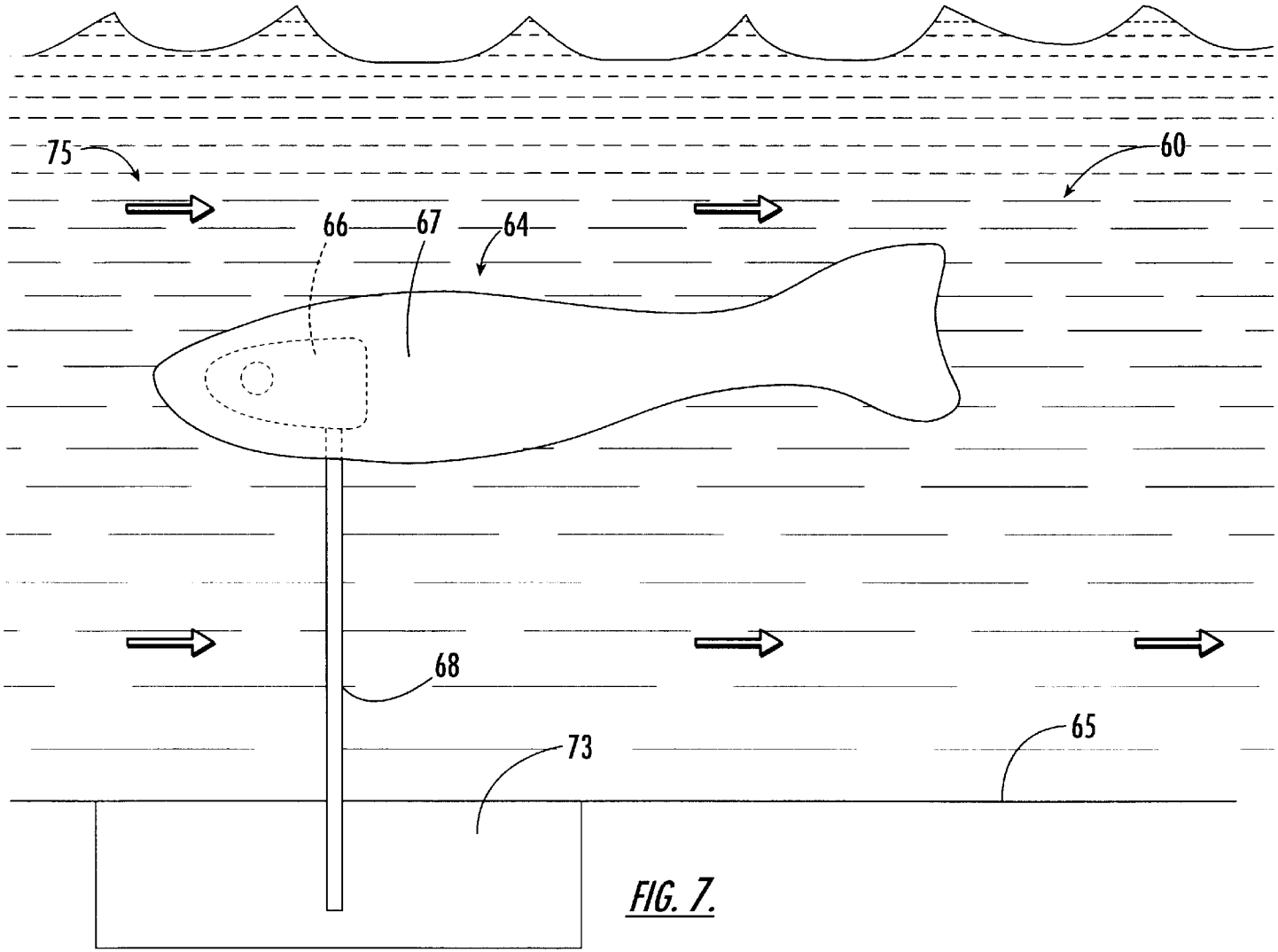
FIG. 7 shows a side view of a device of the present invention which utilizes a stationary swimming aquatic creature simulator to either transduce energy of a flowing fluid into oscillating rotary output to power a generator, or to transduce oscillating rotary input into rearwardly directed fluid flow.

In addition to providing lifelike swimming aquatic creature simulators, the present invention finds application in areas wherein the efficiencies of the propulsion mechanics of aquatic creature motion can be exploited. Referring to FIG. 7, there is shown a transducing device, generally designated 60, having an elongate tapered body 64 structurally and materially similar to body 14 of fish simulator 10 of FIG. 3. Body 64 is submerged within a body of fluid 75, such as water, which is flowing as the directional arrows indicate, i.e., from left to right. One end of rotary output element 68 connects to anchor member 66 at a point on body 64 forward of center of mass 67. The other end of rotary output element 68 engages generator 73, which is stationary relative to the flowing fluid. As the fluid flows past elastomeric body 64 and causes undulating movements therein, the fluid is slowed. The energy of the fluid is transduced to oscillating motion of element 68 which is output to generator 73. The energy of the flowing fluid is thereby efficiently extracted and transduced to another type of energy transferable to a remote location. It will also be appreciated by those of skill in the art that in addition to slowing down the flow of fluid, therefor finding potential application in preventing erosion riverbanks and the like, the transducer of FIG. 7 can also function as a flow meter whereby the oscillating motion of rotary output element 68 translates to a fluid flow speed.

Further referring to FIG. 7, the following disclosed system may perform to generate thrust in an otherwise static fluid. Specifically, one end of rotary input element 68 connects to anchor member 66 and body 64 at a point on body 64 forward of center of mass 67. The other end of rotary input element 68 engages motor 73, which forms at least a part of base 65. When motor 73 is activated, rotary input element 68 is oscillated in a rotary fashion, which as previously described promotes rearwardly propagating undulating movements along body 64. As motor 73 and rotary input element 68 combine to fix the position of elastomeric body relative to base 65, the undulating movements of body 64 cause the fluid to be transported from the forward portion of body 64 toward the rearward portion of body 64. Device 60 can find useful application in pump systems or conveying systems which need a gentle propelling current to transport objects suspended in a fluid.

Construction of the elongate body of a fish simulator according to the present invention may be accomplished by a number of methods as are known in the art, including but not limited to injection molding. A mold may be formed from a dead fish, or alternatively from a model which has been shaped to the appropriate size and shape. Flexible cables, rigid shafts, anchor members, internal motors, or other motion imparting means may be positioned within the mold. An appropriate elastomeric material is then injected into the mold and allowed to cool or is otherwise cured, at which time it is removed from the mold. Inclusion of an anchor member is not an absolute requirement, as long as the shaft, cable or other motion imparting means is sufficiently secured to the body after curing, for example, by having an appropriately porous or chemically bonded means on the bottom of the cable or shaft. In other words, the portion of the cable or shaft encased by the body may serve as the anchor member. Where it is desirable to decrease the density of a simulator to account for a weighty motor or anchor member, the elastomeric material can, for example, be whipped into a froth or filled with microballoons before insertion into the mold. The resulting simulator, with either pockets of air or air-filled balloons within the body, is thereby provided with greater buoyancy.

As is evident from the foregoing disclosure, the present invention provides a means to recreate the swimming motion of aquatic creatures in a lifelike manner. In application, the invention provides a swimming aquatic creature simulator which propels itself through a fluid medium in a lifelike manner. Furthermore because of its simple construction and fabrication from readily available materials, a swimming aquatic creature simulator according to the present invention is inexpensive to manufacture. An aspect of the simulators which will make them more coveted is the ability of a user to play an active role in the three-dimensional swimming motion of the simulator, as the user effectively provides via rotary oscillating input both the actual propelling power and guidance for the swimming motion. The present invention also finds application in more serious endeavors. The close imitation of swimming aquatic creatures by the simulators permits them to be widely utilized in scientific research of aquatic and marine life. Moreover, instead of being used as a toy, the simulators which employ the propulsion mechanics of fish motion can be used to either transport otherwise static fluid or to extract energy from a fluid flowing along the device.

The present invention has many other applications beyond use as a toy or for scientific purposes. For example, appropriately constructed simulators of the present invention may be used as fishing lures or as a water vehicle suitably sized to hold one or more persons. The invention might also possibly be used to transport a wide variety of items such as slurry (mud, particulate matter, debris), fruit, or blood (the lack of abrading surfaces could prevent excessive breaking of blood cells and might help prevent the resulting clotting induced by some other machines). Other possible applications include beverage stirrers (possibly made from an edible material), an oceanographic sensing vessel, or a military vessel, torpedo or mine providing a camouflaging fishlike acoustical signature.

The foregoing examples are illustrative of the present invention, and are not to be construed as limiting thereof. The invention is defined by the following claims, with equivalents of the claims to be included therein.

That which is claimed is:

1. A swimming creature simulator consisting of:

a unitary elongate body of elastomeric material, said unitary elongate body approximately as dense as water and comprising a front tip, a forward portion forward of the center of mass of said elastomeric body, a rearward tail portion rearward of the center of mass of said elastomeric body, a rear tip, and a top and bottom, said rearward tail portion tapered rearwardly in a frontal plane of said unitary elongate body so as to have a greater cross-sectional thickness toward the center of mass than at said rear tip; and means for imparting oscillating rotational motion at a point forward of the center of mass of said unitary elastomeric body, said rotational motion occurring about an axis perpendicular to said frontal plane and lying in the median plane of said elongate body, wherein when said unitary elastomeric body is placed in water, said oscillating rotational motion causes rearward traveling undulating movements of said elastomeric body which propel said elastomeric body through the water.

2. The simulator of claim 1 wherein said elastomeric material has a resilience of between 30–98% and a Young's modulus of elasticity of between $1.5\times10^{-2}$ to about $2.9\times10^{6}$ megapascals.

3. The simulator of claim 1 wherein said tapered rearward tail portion has a taper of from about 0.5 degrees to about 35 degrees.

4. The simulator of claim 1 wherein said oscillating rotational motion imparting means is selected from the group consisting of (a) a rigid shaft having a bottom end and a top end, said top end graspable by a user, and (b) a flexible cable having a bottom end and a top end, said top end graspable by a user.

5. The simulator of claim 1 wherein said unitary elongate body comprises a tail fin lying in the median plane of said elongate body.

6. The simulator of claim 4, further comprising an anchor member embedded within said elastomeric body and secured to said bottom end of said oscillating rotational motion imparting means.

7. The simulator of claim 6 wherein said anchor member has an eyehole therein.

8. The simulator of claim 6 wherein said anchor member comprises a surface adapted to bond to said elastomeric body.

9. The simulator of claim 1 wherein said oscillating rotational motion imparting means comprises an internal motor.

10. The simulator of claim 9 wherein said internal motor is remotely controlled.

11. The simulator of claim 9 wherein said internal motor is a wind-up motor.

12. A method for propelling a swimming creature simulator in a lifelike manner through water comprising:

providing a simulator of claim 1;

submerging said simulator in water; and imparting oscillating rotational motion to said elongate body at a point forward of the center of mass of said elongate body, said rotational motion occurring about an axis in the median plane of said elongate body.

13. A method for propelling a swimming creature simulator in a lifelike manner through water comprising:

providing a simulator of claim 4;

submerging said simulator in water;

gripping said top end of said motion imparting means and imparting oscillating rotational motion thereto.

14. A device for transducing oscillating rotary movement into rearwardly propagating waves of undulation consisting of:

a unitary elongate body of elastomeric material having:

a center of mass, a front tip and a forward portion forward of the center of mass, a rear tip and a rearward portion rearward of the center of mass, said rearward portion tapered rearwardly in a frontal plane of said elongate body so as to have a greater cross-sectional thickness toward the center of mass than at said rear tip, means for imparting oscillating rotational motion to a point forward of the center of mass, said rotational motion occurring about an axis perpendicular to said frontal plane and lying in the median plane of said unitary elongate body, a body of fluid, whereby when said unitary elongate body is placed in said body of fluid, imparting oscillating rotational motion to said means for imparting oscillating rotational motion causes rearwardly propagating waves of undulation in said unitary elongate body.

15. The device of claim 14 wherein said elastomeric material has a resiliency of between 30% to about 98% and a Young's modulus of elasticity of between about 0.1 megapascals to about 10 megapascals.

16. The device of claim 14 wherein said tapered rearward tail portion has a taper of from about 0.5 degrees to about 30 degrees.

17. The device of claim 14 wherein the means for imparting oscillating rotational motion comprises a flexible cable.

18. The device of claim 14 wherein the means for imparting oscillating rotational motion comprises a rigid shaft.

* * * * *